US006655091B1

(12) United States Patent
Iwasaki

(10) Patent No.: US 6,655,091 B1
(45) Date of Patent: Dec. 2, 2003

(54) SHUTTER ASSEMBLY

(76) Inventor: Mark Iwasaki, 94-155 Leoole St., no. D6-7, Waipahu, HI (US) 96797

( * ) Notice: Subject to any disclaimer, the term of this patent is extended or adjusted under 35 U.S.C. 154(b) by 0 days.

(21) Appl. No.: 10/093,305

(22) Filed: Mar. 6, 2002

(51) Int. Cl.[7] ..... G06B 7/08
(52) U.S. Cl. ..... 49/403; 49/74.1; 49/87.1
(58) Field of Search ..... 49/403, 74.1, 87.1, 49/409, 116, 404; 160/104, 174 R

(56) References Cited

U.S. PATENT DOCUMENTS

| | | | | |
|---|---|---|---|---|
| 3,452,477 A | * | 7/1969 | Sassano | 49/116 |
| 4,509,290 A | | 4/1985 | Stanfield, Jr. | |
| 4,858,400 A | | 8/1989 | Foyt | |
| 4,936,048 A | | 6/1990 | Ruggles | |
| 5,020,276 A | | 6/1991 | Zittell | |
| 5,060,442 A | | 10/1991 | Chubb | |
| 5,216,837 A | * | 6/1993 | Cleaver et al. | 49/82.1 |
| 5,379,551 A | | 1/1995 | Swapp | |
| 5,630,295 A | * | 5/1997 | Neiman | 49/403 |
| 5,887,386 A | * | 3/1999 | Alexanian et al. | 49/403 |
| 5,907,929 A | | 6/1999 | Poma et al. | |
| 5,946,873 A | | 9/1999 | Schiedegger et al. | |

FOREIGN PATENT DOCUMENTS

| | | | | |
|---|---|---|---|---|
| JP | 10-169329 | * | 6/1998 | 49/403 |

* cited by examiner

*Primary Examiner*—Jerry Redman
(74) *Attorney, Agent, or Firm*—Michael I. Kroll

(57) ABSTRACT

A shutter assembly replaces one or more of the conventional fixed rails with one or more attaching louvers that fixedly attach the attaching louver to the left and right stiles, completing the framing function of the replaced rail(s). A hanger bolt is attached to the attaching louver end and extends through a spacing washer and stile holes for a locknut and washer to complete the attachment. The non-attaching louvers have louver pin assemblies with a nail for driving into the louver, a spacer flange, and an expandable bushing post with a central recess. A finned bushing encompasses the bushing post and a tensioning nail is driven into the bushing post recess to expand the bushing post causing the bushing to bear on the sides of a stile recess sized to receive the bushing. This frictional relationship maintains the position of the louvers when rotated by the tilt rod.

21 Claims, 11 Drawing Sheets

SHUTTER ASSEMBLY

BACKGROUND OF THE INVENTION

1. Field of the Invention

The present invention relates generally to shutter blinds and more specifically, to shutter blinds having no top or bottom rail.

2. Description of the Prior Art

There are other shutter blind devices designed for air flow and light admittance. Typical of these is U.S. Pat. No. 4,858,400 issued to Foyt on Aug. 22, 1989.

Another patent was issued to Stanfield, Jr. on Apr. 9, 1985 as U.S. Pat. No. 4,509,290. Yet another U.S. Pat. No. 4,936,048 was issued to Ruggles on Jun. 26, 1990 and still yet another was issued on Jun. 4, 1991 to Zittell as U.S. Pat. No. 5,020,276.

Another patent was issued to Chubb on Oct. 29, 1991 as U.S. Pat. No. 5,060,442. Yet another U.S. Pat. No. 5,379,551 was issued to Swapp on Jan. 10, 1995. Still yet another was issued on Jun. 1, 1999 to Poma et al. as U.S. Pat. No. 5,907,929 and another was issued to Schiedegger et al. on Sep. 7, 1999 as U.S. Pat. No. 5,946,873.

U.S. Pat. No. 4,858,400

Inventor: Douglas C. Foyt

Issued: Aug. 22, 1989

A multi section shutter assembly constructed of plastic is provided and at least one section includes louver slots extending between the stiles thereof and connected therebetween in a manner enabling the opposite end of one or more slats to be severed from the corresponding stiles and the stile ends are also severable from the remainder of the stiles, one pair of ends of the stiles being interconnected by an end mullion extending therebetween. The other section of the shutter includes stiles which may be lap engaged over the stiles of one section and also includes an end mullion. By this construction, a purchased shutter may be shortened as desired and may be purchased in various colors and styles from a relatively small inventory of different parts.

U.S. Pat. No. 4,509,290

Inventor: Alvin M. Stanfield, Jr.

Issued: Apr. 9, 1985

An improved shutter construction is provided with a plurality of louvers supported by relatively low friction two-piece bushing assemblies for pivoting movement with respect to a shutter frame in response to operation of a louver tilt rod. The bushing assemblies permit movement of the louvers together substantially without binding between an open position to admit light and air and a closed position wherein ribs and grooves formed on the louvers interlock with one another such that the louvers substantially block passage of light and air.

U.S. Pat. No. 4,936,048

Inventor: Kay Ruggles

Issued: Jun. 26, 1990

The present invention is a swivel shutter that incorporates louvers that are pivotally mounted in a rectangular frame that is formed by joining, at their ends, top and bottom rails with left and right stiles. The louver pivotal mounting includes fixed and retracting conical shaped pivots that are individually fitted as aligned pairs or are arranged as bars of joined pivot sections into appropriate holes or slots in the left or right stiles. The individual pivots are for fitting into conical shaped holes that are formed in louver ends, the pivot of each retracting pivot to retract against a spring biasing into and below the level of the stile side, allowing a louver end hole to be aligned there within. The invention further includes a tilt rod for mounting across aligned louver ends to simultaneously pivot the louvers between open and closed attitudes and a system for applying, to each louver faces, a section or sections of a flexible material as a veneer.

U.S. Pat. No. 5,020,276

Inventor: Frank F. Zittell

Issued: Jun. 4, 1991

A shutter assembly comprising a plurality of vertically spaced, horizontally extending louvers rotating between a pair of opposed vertical side rails causing them to control the light and air passing through the shutter from a maximum, when in the open position, to a minimum, when in the closed position. All parts are made primarily of wood. The pivoting movement is in response to the operation of a tilt rod containing "U" shaped, malleable metal staples coupled with similar staples inserted into each louver, and of a type normally used. Both sets of staples are crimped as close as possible to their junction points so that they become two interlocking eyelets. When the shutter is in the upright position and the louvers are closed, the surface of the louver facing the observer is considered the front surface and the margin containing the staple, the upper margin. From a position about half way down the upper margin there is a slightly angled slope which intersects the rear surface of the louver. There is a rabbet formed in the lower margin, front surface of the louver into which the upper margin of the adjoining louver dovetails when the louvers are closed. This rabbet consists of one side extending perpendicularly from the front surface of the louver to where it intersects another side sloping parallel to the slope formed in the upper margin. All extremities are rounded.

U.S. Pat. No. 5,060,442

Inventor: Norman L. Chubb

Issued: Oct. 29, 1991

A louvered plastic building product comprising a pair of plastic side rails which may be cut to desired length, a plurality of plastic shutter panels sidably received within tracks extending along side rails, upper and lower plastic end rails extending between the side rails and capturing the panels in assembly, and a mullion piece separating the panels. The length of the side rails may be greater than the assembled length of the upper and lower end rails, panels and mullion. The mullion piece is provided with a lip that overlaps a portion of the adjacent panel such that when the various parts are assembled, the panels and mullion piece can be moved vertically to accommodate dimensional variations in length between the side rails and the assembled parts.

U.S. Pat. No. 5,379,551

Inventor: Ronald L. Swapp

Issued: Jan. 10, 1995

A window shutter having vertical stiles and horizontal rails formed of extruded polymeric material. The corners where the rails and stiles are joined are reinforced by interconnected rigid load-transferring member. Louvers are moveable relative to the stiles and pivot on molded pins which may be provided with individual gears engageable with an elongate rack for synchronized movement. The invention comprehends a fabrication and assembly process.

U.S. Pat. No. 5,907,929

Inventor: Frank Poma et al.

Issued: Jun. 1, 1999

The present invention provides, in one embodiment an awning that permits light and air to enter the structure to which the awning is attached, that can be utilized to protect against major storms, and that can pass strict building code standards testing. The awning includes a perimeter framework that is adapted to receive a removable ridgid support plate. In an alternate embodiment, the invention provides a shutter that is inexpensive, easy and quick to manufacture, that can provide protection against major storms, and that can pass strict building code standards testing. The shutter includes modular louver sections that have an integral rigid backing plate.

U.S. Pat. No. 5,946,873

Inventor: Charles E, Schiedegger et al.

Issued: Sep. 7, 1999

A component shutter assembly and method of forming same. The assembly comprises a one-piece molded plastic, integrally formed shutter panel. The shutter panel may be molded in a small plurality of standard lengths and then one or both ends thereof cut to shorten the shutter panel to a specific, desired length once it is determined what-specific length of shutter is needed for a particular application. An independent, integrally formed end panel may then be secured to one or both ends of the cut shutter panel and ultrasonically welded thereto to form a finished component shutter assembly having a particular desired length and the appearance of a one-piece, integrally formed shutter. Embodiments directed to raised panel and louvered shutters are disclosed, as is a removable center panel section which may be used in connection with the louvered shutter panels if it is desired to provide a mid-panel section which is offset from the mid-point of the overall length of the shutter panel. By providing standard length shutter panels which may be cut to specific desired lengths, component shutter assemblies can be created which have a wide plurality of overall lengths from only a very small plurality of standard length panels. The assembly of each of the component shutter assemblies is also simplified considerably as a much smaller plurality of independent component parts are required to be assembled to form a finished component shutter assembly.

While these louver blinds may be suitable for the purposes for which they were designed, they would not be as suitable for the purposes of the present invention, as hereinafter described.

It is thus desirable, to provide a louvered shutter assembly that contains no top or bottom rail providing extra louvers in place of the top and bottom rail held in place by hanger bolts while the other louvers have restricted movement because of the tensionable louver pins communicating between the louvers and the stiles. It is further desirable to provide a shutter blind that is quickly manufactured and cost effective, and still maintain all the functions and looks of conventional shutters.

SUMMARY OF THE PRESENT INVENTION

A primary object of the present invention is to provide a shutter blind having no top or bottom rail.

Another object of the present invention is to provide a shutter blind having no top or bottom rail and having a plurality of parallel louvers supported by a two piece shutter frame.

Yet another object of the present invention is to provide a shutter blind with parallel louvers mounted for pivoting movement to an open position and a closed position in response to the operation of a singular louver tilt rod.

One other object of the present invention is to provide a shutter assembly wherein the louvers are pivotally connected to the stiles with louver pins that provide rotational resistance with the bushings into which they are inserted so as to allow the louvers to remain in the position in which they are placed.

Yet another object of the present invention is to provide a shutter assembly which selectively blocks or admits light and air through windows and doors.

Still another object of the present invention is to provide a shutter assembly that is simple and installation is as easy and quick as conventional blinds.

Another object of the present invention is to provide a shutter blind device that is economical in cost to manufacture and sell.

Additional objects of the present invention will appear as the description proceeds.

The present invention overcomes the shortcomings of the prior art by providing a louvered shutter assembly having no top or bottom rail.

The top and bottom rails on conventional shutters are structural members for maintaining a ninety degree angle for each corner of the shutter assembly. While this may be suitable for new homes it does not consider the older home which invariably settles over time making doors and windows out of square. The present invention permits vertical movement of the stiles which places the louver slats slightly out of horizontal but appears in alignment with the window frame. Also without the rails more louver slats can be installed between the stiles, allowing more air and light through the shutter.

Hanger bolts are threaded into the top and bottom louvers and are fixedly attached to the stiles with nuts to hold the assembly together by preventing the stiles from separating. More louvers can be used with hanger bolts to prevent the medial portion of the stiles from bowing in longer shutter assemblies, where more louvers are being used.

The remaining louvers are supported on each distal end by the stiles. These louvers are pivotally maintained to the stiles by a plurality of louver pin assemblies, each louver pin assembly including: a louver insertion nail with anti-spin flanges for insertion into the louver; a spacer flange to act as a washer for maintaining a specific gap between each louver and vertical stile; and an expandable bushing post with a central longitudinal recess open on the distal end. A finned bushing is placed over the expandable bushing post and a tension pin is inserted in various depths therein to control the amount the bushing post expands, therefore exerting tension against the central bushing recess in the stile. The interior sides of the stiles have a plurality of bushing recesses for receiving the louver pin assembly bushings. The bushings will not rotate therein due to the bushing fins bearing on the stile recesses. Rotational movement occurs in response to an external force applied through a tilt mechanism, such as a tilt rod or a conventional rotating handle and interconnected assembly attached to the louvers.

A shutter assembly is provided, comprising: a pair of opposite side, elongated and generally parallel upright stiles, each having first portion and a second portion; a rail fixedly attaching the stile second portions; a plurality of louvers spaced between and along the length of the stiles, the louvers having a longitudinal axis, each louver being secured between the stiles for rotation about said louver's longitudinal axis, only one of the louvers being a first portion attaching louver, the attaching louver fixedly attaching the stile first portions, such that said attaching louver, the stiles and the rail form a frame; and a tilting mechanism for simultaneously rotating all the louvers between open and closed positions.

In another embodiment, the tilt mechanism is a tilt rod attached to each of the louvers.

In another embodiment, the tilt mechanism is an interconnected assembly of members attached to the louvers, the tilt mechanism further having a handle for rotation, the interconnected assembly being responsive to the handle rotation such that the louvers are rotated.

In another embodiment, the first portion attaching louver is the uppermost of the plurality of louvers.

In another embodiment, the first portion attaching louver is the lowermost of the plurality of louvers.

In another embodiment, the first portion attaching louver has a first end and a second end, each end having a hole; the stile first portions each have a hole, the holes being generally aligned with the attaching louver longitudinal axis; and the assembly further comprises two elongated members, each member being inserted through one of the stile first portion holes, the inserted end then being inserted into one of the attaching louver end holes, the members being adapted such that the members rotate in the stile first portion holes and are fixed for non-rotation in the attaching louver end holes.

In another embodiment, the assembly further comprises a pair of nuts, the elongated members have threaded ends, and the attaching louver end holes are threaded for receiving one of the elongated member's threaded ends, the nuts being threadably attached to other elongated member's end.

In another embodiment, the stile first portion holes each have an enlargement, the enlargements each being adapted to allow one of the nuts to recess completely within the hole enlargement.

In another embodiment, the assembly further comprises a pair of stile recesses aligned with each non-attaching louver, and a pair of louver pin assemblies for securing each of the non-attaching louvers to the stiles, each of the louver pin assemblies having: a spacer flange, a louver insertion nail, and an expandable bushing post, the insertion nail extending from the spacer flange and the bushing post extending from the spacer flange in the opposite direction from the insertion nail, the insertion nail having anti-slip flanges running longitudinally along the nail, the bushing post having a recess, the insertion nail being driven into the non-attaching louver end, the anti-slip flanges preventing rotation of the nail in said louver; a bushing having flexible exterior fins and a recess, the recess being sized to receive the bushing post; and a tension nail for driving into the bushing post recess causing the bushing post to expand against the bushing, said expansion causing the bushing to expand and the bushing fins to increasingly bear upon the stile recess interior when the bushing is in the stile recess, such that the bushing can rotate in response to the tilt mechanism motion, but will maintain position when the tilt mechanism motion ceases.

In another embodiment, the attaching louver has a pair of louver threaded holes, the stiles each have a pair of stile holes with enlarged exterior portions, each of the stile holes being aligned with one of the attaching louver threaded holes, and the assembly further comprises a pair of louver securement assemblies for fixedly attaching the attaching louver to the stiles, each of the louver securement assemblies having: an elongated member having two threaded ends, one end for threading into one of the attaching louver threaded holes; a spacer for positioning on the elongated member between the attaching louver and the stile; a nut for threadably attaching to the other threaded end after insertion through the stile hole, the tightened nut resting at least partially in the stile hole enlarged portion, the tightened nut fixedly attaching the stile to the louver, such that the elongated member rotates in the stile hole, but not in the threaded louver hole, the rotation being in response to motion of the tilt mechanism.

In another embodiment, the assembly further comprises a pair of spacers and the attaching louver has a first and second end, one of the spacers being positioned between the attaching louver first end and one of the stiles, the other spacer positioned between the attaching louver second end and the other of the stiles.

In another embodiment, the assembly has upwardly extending rollers and is fitted in a frame having a track for suspending the rollers, allowing rolling movement of the assembly within the frame.

There is provided a shutter assembly, comprising: a pair of opposite side, elongated and generally parallel upright stiles, each having an upper portion and a lower portion; a plurality of louvers spaced between and along the length of the stiles, the louvers having a longitudinal axis, each louver being secured between the stiles for rotation about said louver's longitudinal axis, only one of the louvers being an upper attaching louver, and only one of the other louvers being a lower attaching louver, the upper attaching louver fixedly attaching the stile upper portions, the lower attaching louver fixedly attaching the stile lower portions, such that said attaching louvers and the stiles form a frame; and a tilting mechanism for simultaneously rotating all the louvers between open and closed positions.

In another embodiment, the stiles have a inner portion and only one of the plurality of louvers is an inner attaching louver, the inner attaching louver fixedly attaching the stile inner portions.

In another embodiment, the tilt mechanism is a tilt rod attached to each of the louvers.

In another embodiment, the tilt mechanism is an interconnected assembly of members attached to the louvers, the tilt mechanism further having a handle for rotation, the interconnected assembly being responsive to the handle rotation such that the louvers are rotated.

In another embodiment, the upper attaching louver is the uppermost of the plurality of louvers, and the lower attaching louver is the lowermost of the plurality of louvers.

In another embodiment: the attaching louvers each have a first end and a second end, each end having a hole; the stile upper portions and lower portions each have a hole, each of the holes being generally aligned with one of the attaching louvers' longitudinal axes; and the assembly further comprises four elongated members, each member being inserted through one of the stile upper portion or lower portion holes, the inserted end then being inserted into one of the attaching louvers' end holes, the members being adapted such that the members rotate in the stile upper portion and lower portion holes and are fixed for non-rotation in the attaching louvers' end holes.

In another embodiment, the assembly further comprises two pair of nuts, the elongated members have threaded ends, and the attaching louvers' end holes are threaded for receiving one of the elongated member's threaded ends, the nuts being threadably attached to other elongated member's end.

In another embodiment, the stile upper and lower portion holes each have an enlargement, the enlargements each being adapted to allow one of the nuts to recess completely within the hole enlargement.

In another embodiment, the assembly further comprises a pair of stile recesses aligned with each non-attaching louver, and a pair of louver pin assemblies for securing each of the non-attaching louvers to the stiles, each of the louver pin assemblies having: a spacer flange, a louver insertion nail, and an expandable bushing post, the insertion nail extending from the spacer flange and the bushing post extending from the spacer flange in the opposite direction from the insertion nail, the insertion nail having anti-slip flanges running longitudinally along the nail, the bushing post having a recess, the insertion nail being driven into the non-attaching louver end, the anti-slip flanges preventing rotation of the nail in said louver; a bushing having flexible exterior fins and a recess, the recess being sized to receive the bushing post; and a tension nail for driving into the bushing post recess causing the bushing post to expand against the bushing, said expansion causing the bushing to expand and the bushing fins to increasingly bear upon the stile recess interior when the bushing is in the stile recess, such that the bushing can rotate in response to the tilt mechanism motion, but will maintain position when the tilt mechanism motion ceases.

In another embodiment, the attaching louvers each have a pair of louver threaded holes, the stiles each have a pair of stile holes with enlarged exterior portions, each of the stile holes being aligned with one of the attaching louver threaded holes, and the assembly further comprises a pair of louver securement assemblies for fixedly attaching each of the attaching louvers to the stiles, each of the louver securement assemblies having: an elongated member having two threaded ends, one end for threading into one of the attaching louver threaded holes; a spacer for positioning on the elongated member between the attaching louver and the stile; a nut for threadably attaching to the other threaded end after insertion through the stile hole, the tightened nut resting at least partially in the stile hole enlarged portion, the tightened nut fixedly attaching the stile to the louver, such that the elongated member rotates in the stile hole, but not in the threaded louver hole, the rotation being in response to motion of the tilt mechanism.

In another embodiment, the assembly further comprises two pairs of spacers and the upper attaching louver has a first and second end, and the lower attaching louver has a first and second end, one of the spacers in the first pair being positioned between the upper attaching louver first end and one of the stiles, the other spacer in the first pair being positioned between the attaching louver second end and the other of the stiles, and one of the spacers in the second pair being positioned between the lower attaching louver first end and one of the stiles, the other spacer in the second pair being positioned between the other of the stiles.

In another embodiment, the assembly has upwardly extending rollers and is fitted in a frame having a track for suspending the rollers, allowing rolling movement of the assembly within the frame.

A shutter assembly is provided, comprising: a pair of opposite side, elongated and generally parallel upright stiles, each having a first portion and a second portion; a rail fixedly attaching the stile second portions; a plurality of louvers spaced between and along the length of the stiles, the louvers having a longitudinal axis, each louver being secured between the stiles for rotation about said louver's longitudinal axis; means for fixedly attaching only one of the louvers to the stile first portions such that said only one louver, the stiles, and the rail form a frame; and a tilting mechanism for simultaneously rotating all the louvers between open and closed positions.

In another embodiment, the tilt mechanism is a tilt rod attached to each of the louvers.

In another embodiment, the tilt mechanism is an interconnected assembly of members attached to the louvers, the tilt mechanism further having a handle for rotation, the interconnected assembly being responsive to the handle rotation such that the louvers are rotated.

There is provided a shutter assembly, comprising: a pair of opposite side, elongated and generally parallel upright stiles, each having an upper portion and a lower portion; a plurality of louvers spaced between and along the length of the stiles, the louvers having a longitudinal axis, each louver being secured between the stiles for rotation about said louver's longitudinal axis; means for fixedly attaching only one of the louvers to the stile upper portions and fixedly attaching only a second one of the louvers to the stile lower portions, such that said only one louver, said second one of the louvers and the stiles form a frame; and a tilting mechanism for simultaneously rotating all the louvers between open and closed positions.

A shutter assembly is provided, comprising: a pair of opposite side, elongated and generally parallel upright stiles, each having an upper portion and a lower portion; a plurality of louvers spaced between and along the length of the stiles, the louvers having a longitudinal axis, each louver being secured between the stiles for rotation about said louver's longitudinal axis, the uppermost of the louvers being an upper attaching louver, and the lowermost of the other louvers being a lower attaching louver, the upper attaching louver fixedly attaching the stile upper portions, the lower attaching louver fixedly attaching the stile lower portions, such that said attaching louvers and the stiles form a frame; a tilting mechanism for simultaneously rotating all the louvers between open and closed positions, the tilt mechanism being a tilt rod attached to each of the louvers, and further wherein: the attaching louvers each have a pair of louver threaded holes, the stiles each have a pair of stile holes with enlarged exterior portions, each of the stile holes being aligned with one of the attaching louver threaded holes, and the assembly further comprises a pair of louver securement assemblies for fixedly attaching each of the attaching louvers to the stiles, each of the louver securement assemblies having: an elongated member having two threaded ends, one end for threading into one of the attaching louver threaded holes; a spacer for positioning on the elongated member between the attaching louver and the stile; a nut for threadably attaching to the other threaded end after insertion through the stile hole, the tightened nut resting at least partially in the stile hole enlarged portion, the tightened nut fixedly attaching the stile to the louver, such that the elongated member rotates in the stile hole, but not in the threaded louver hole, the rotation being in response to motion of the tilt mechanism; the assembly further comprises a pair of stile recesses aligned with each non-attaching louver, and a pair of louver pin assemblies for securing each of the non-attaching louvers to the stiles, each of the louver pin assemblies having: a spacer flange, a louver insertion nail, and an expandable bushing post, the insertion nail extending from the spacer flange and the bushing post extending from the spacer flange in the opposite direction from the insertion nail, the insertion nail having anti-slip flanges running longitudinally along the nail, the bushing post having a recess, the insertion nail being driven into the non-attaching louver end, the anti-slip flanges preventing rotation of the nail in said louver; a bushing having flexible exterior fins and a recess, the recess being sized to receive the bushing post; a tension nail for driving into the bushing post recess causing the bushing post to expand against the bushing, said expansion causing the bushing to expand and the bushing fins to increasingly bear upon the stile recess interior when the bushing is in the stile recess, such that the bushing can rotate in response to the tilt mechanism motion, but will maintain position when the tilt mechanism motion ceases; and the assembly further comprises two pairs of spacers and the upper attaching louver has a first and second end, and the lower attaching louver has a first and second end, one of the spacers in the first pair being positioned between the upper attaching louver first end and one of the stiles, the other spacer in the first pair being positioned between the attaching louver second end and the other of the stiles, and one of the spacers in the second pair being positioned between the lower attaching louver first end and one of the stiles, the other spacer in the second pair being positioned between the other of the stiles.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which:

FIG. 1 is a perspective view of the present invention. Depicted is the shutter assembly of the present invention mounted in a structure. Shown is the shutter with a plurality of louvers between spaced apart stiles having no top and bottom rails.

FIG. 2 is a perspective view of the present invention. Shown is a shutter without a top and bottom rail, having spaced apart stiles with a plurality of louvers positioned therebetween, and having a tilt rod for positioning the louvers between an open and closed position. The upper and lower louvers while being movable are attached to the stiles by hanger bolts extending from the exterior side of the stiles into the louver blades therein forming a frame.

FIG. 3 is an exploded perspective view of the present invention. The inner louvers are pivotally connected to the stiles by a louver pin assembly. Hanger bolts are threaded into the upper and lower louver and connected to the stiles by washer and locknut which keeps the stiles from separating. The interior and exterior washers that sandwich the stiles prevent the louvers from binding with the stiles.

Figure 9:
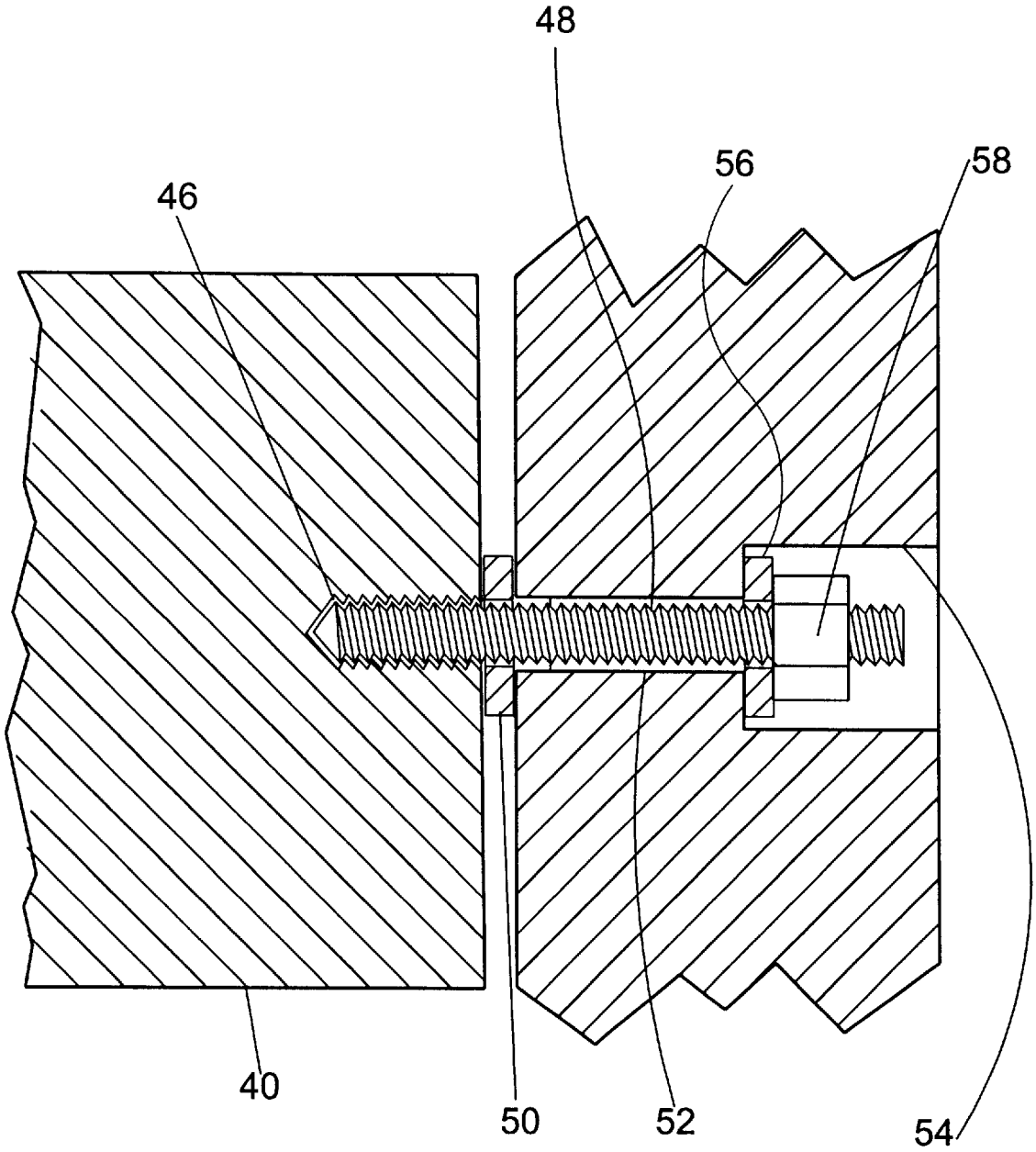

FIG. 9 is a sectional view of the hanger connection between the top louver and the stile. The hanger bolts are threaded into the ends of the top and bottom louvers and connected to the stiles with a nut. The hanger bolts prevent the louvers from separating from the stiles and maintains the entire shutter assembly.

Figure 10:
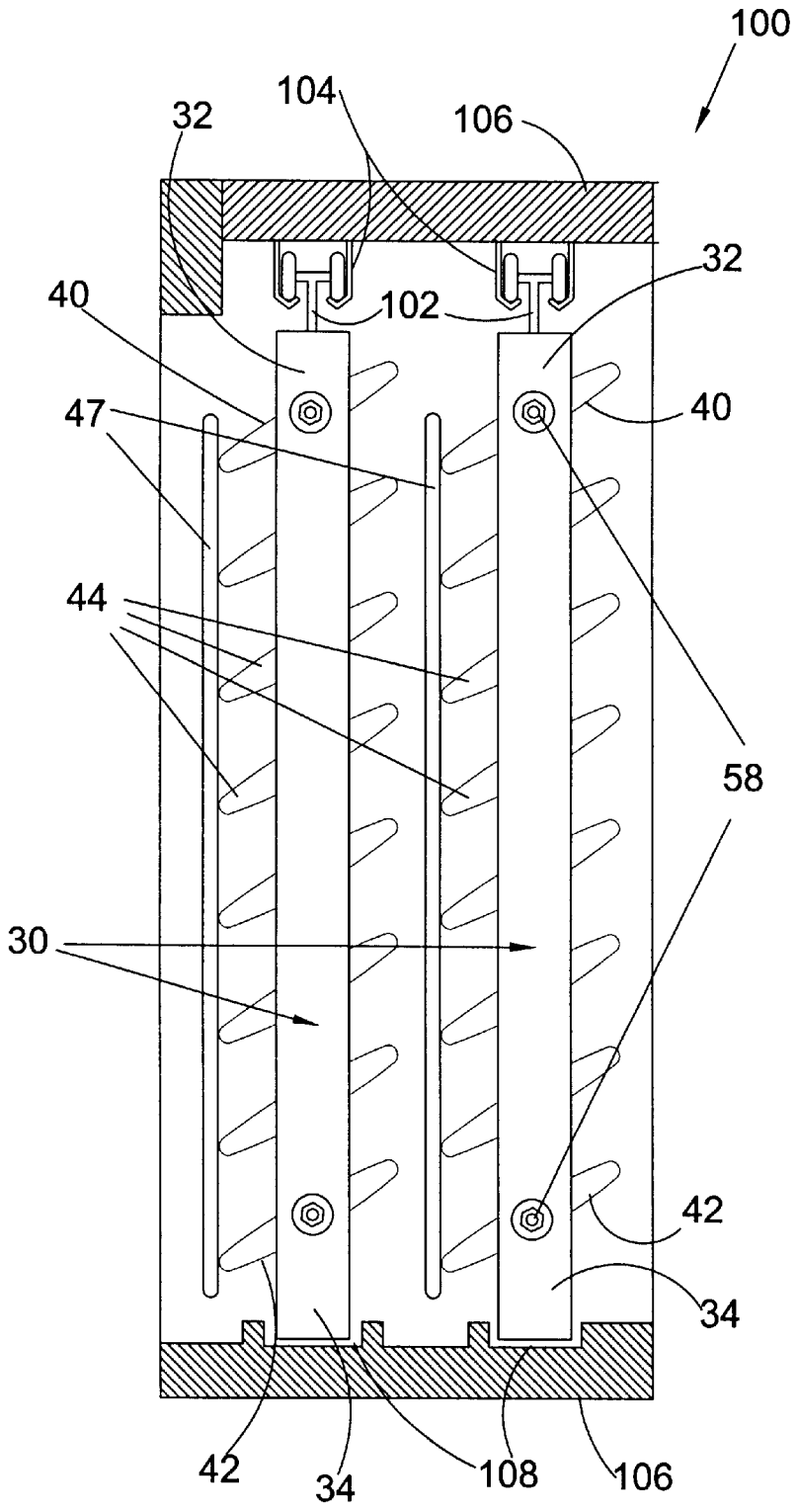

FIG. 10 is a side view of the present invention in an embodiment having double-hung shutter assemblies.

Figure 11:
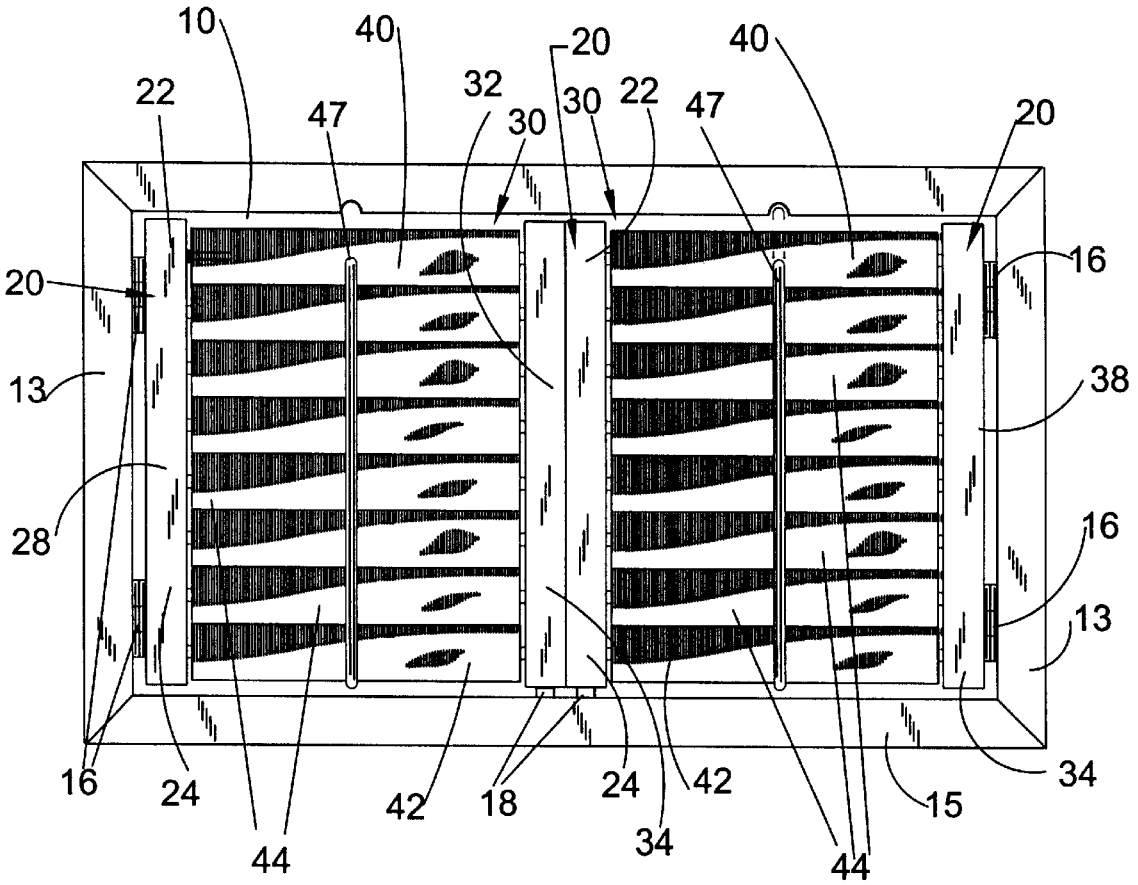

FIG. 11 is a front view of the present invention having a hinged double shutter assembly. Nylon plugs are positioned within the base of one side of the stiles.

DESCRIPTION OF THE REFERENCED NUMERALS

Turning now descriptively to the drawings, in which similar reference characters denote similar elements throughout the several views, the figures illustrate the Shutter Assembly of the present invention. With regard to the reference numerals used, the following numbering is used throughout the various drawing figures.

10 Shutter Assembly of the present invention
11 wall
12 window frame
13 window frame sides
14 window frame top edge
15 window frame bottom edge
16 window frame hinges
20 left stile
22 left stile upper portion
24 left stile lower portion
26 left stile inner edge
28 left stile outer edge
30 right stile
32 right stile upper portion
34 right stile lower portion
36 right stile inner edge
38 right stile outer edge
40 uppermost louver
42 lowermost louver
44 inner louvers
46 uppermost and lowermost louver threaded holes
48 hanger bolt
50 spacer
52 stile hole

54 stile hole recess
56 washer
58 locknut
60 louver pin assembly
62 insertion nail
64 anti-spin flanges
66 spacing flange
68 bushing post
70 bushing post recess
72 bushing
74 bushing center
76 tension pin 76
78 tension pin head
80 bushing fins
82 stile inner edge recess
84 louver nail starter hole
100 alternate embodiment
102 roller assemblies
104 tracks
106 wall frame
108 slot tracks

DETAILED DESCRIPTION OF THE PREFERRED EMBODIMENTS

The following discussion describes in detail the preferred embodiments of the invention. This discussion should not be construed, however, as limiting the invention to those particular embodiments. Practitioners skilled in the art will recognize numerous other embodiments as well. For a definition of the complete scope of the invention, the reader is directed to the appended claims.

Figure 1:
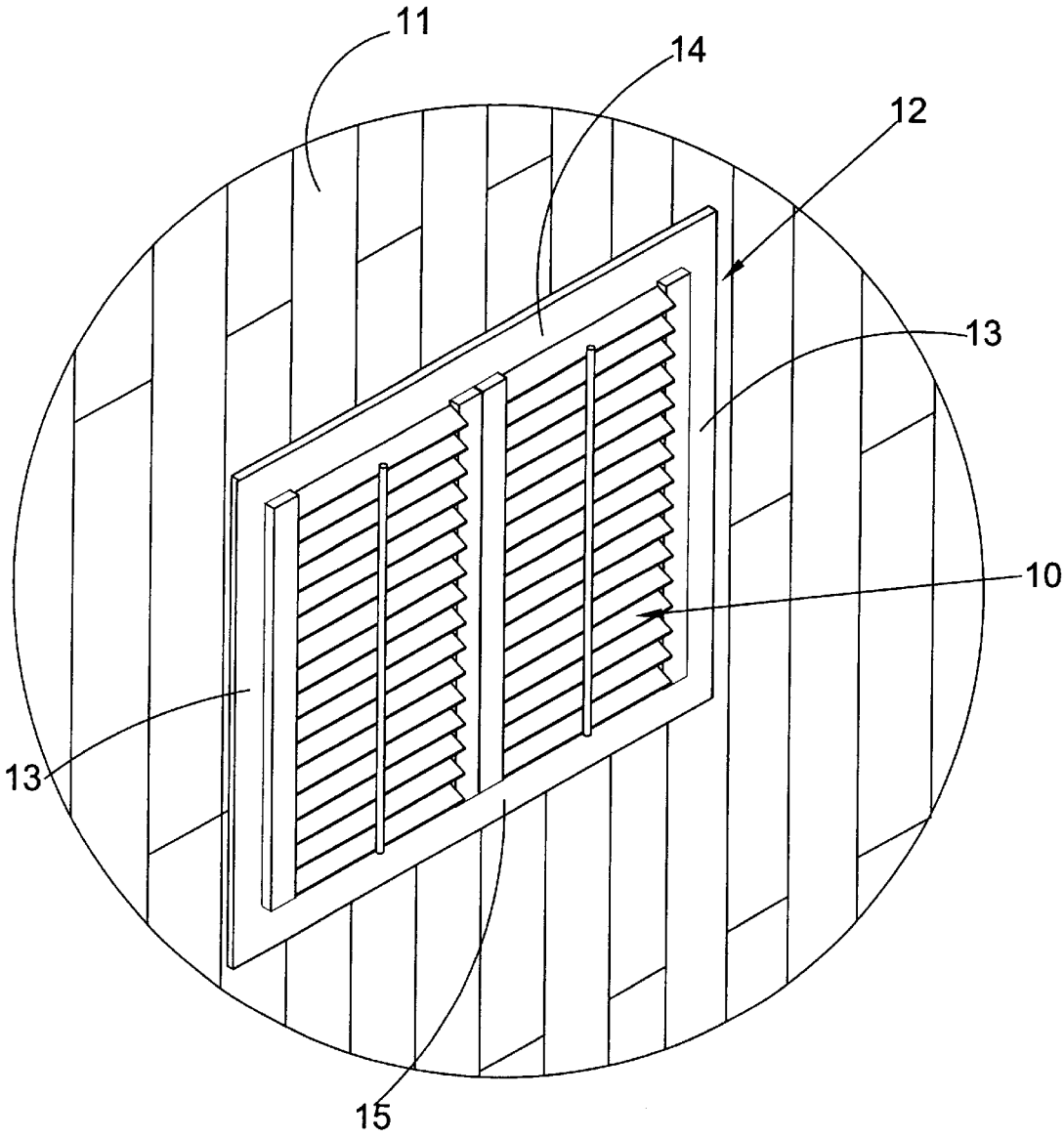

FIGS. 1–11 depict the preferred embodiment of the Shutter Assembly 10, with FIG. 1 and FIG. 11 illustrating the use of the assembly 10 in a wall 11 in a rectangular frame 12 having sides 13, top 14, and bottom 15. FIG. 1 depicts the assembly 10 fixed in the frame 12, while FIG. 11 depicts usage in a frame with the assembly 10 on hinges 16 and support plugs 18.

Figure 2:
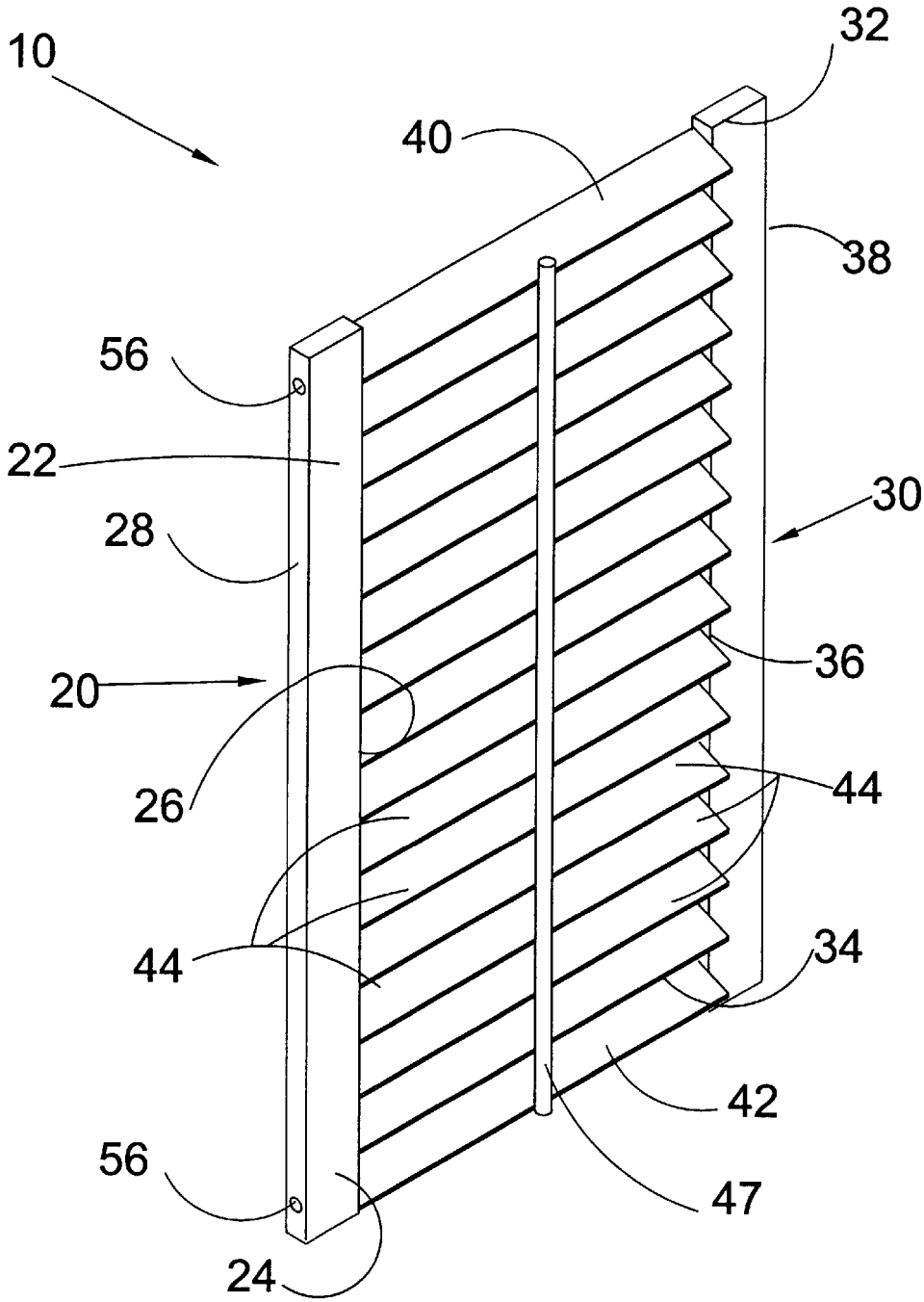

As shown in FIG. 2, the shutter assembly 10 has a left stile 20 having an upper portion 22, a lower portion 24, an inner edge 26 and an outer edge 28. Similarly, a right stile 30 has an upper portion 32, a lower portion 24, an inner edge 36 and an outer edge 38. A special top louver 40 and a special bottom louver 42 are provided, which have a similar exterior appearance to the inner louvers 44. All louvers 40,42,44 are attached uniformly to a tilt rod 46 such that movement of the tilt rod 47 causes a uniform and corresponding movement of all louvers 40,42,44.

Figure 3:
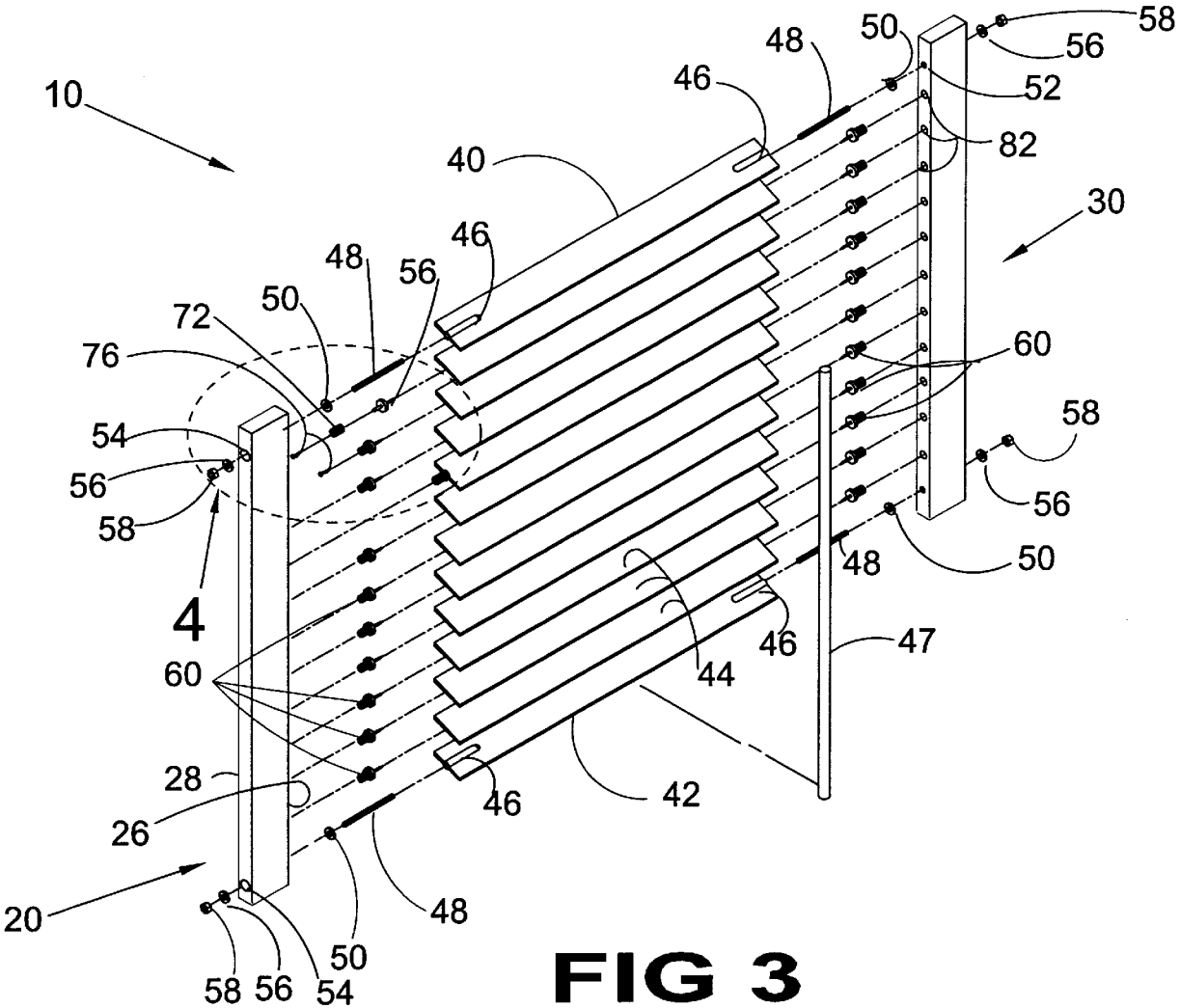
Figure 4:
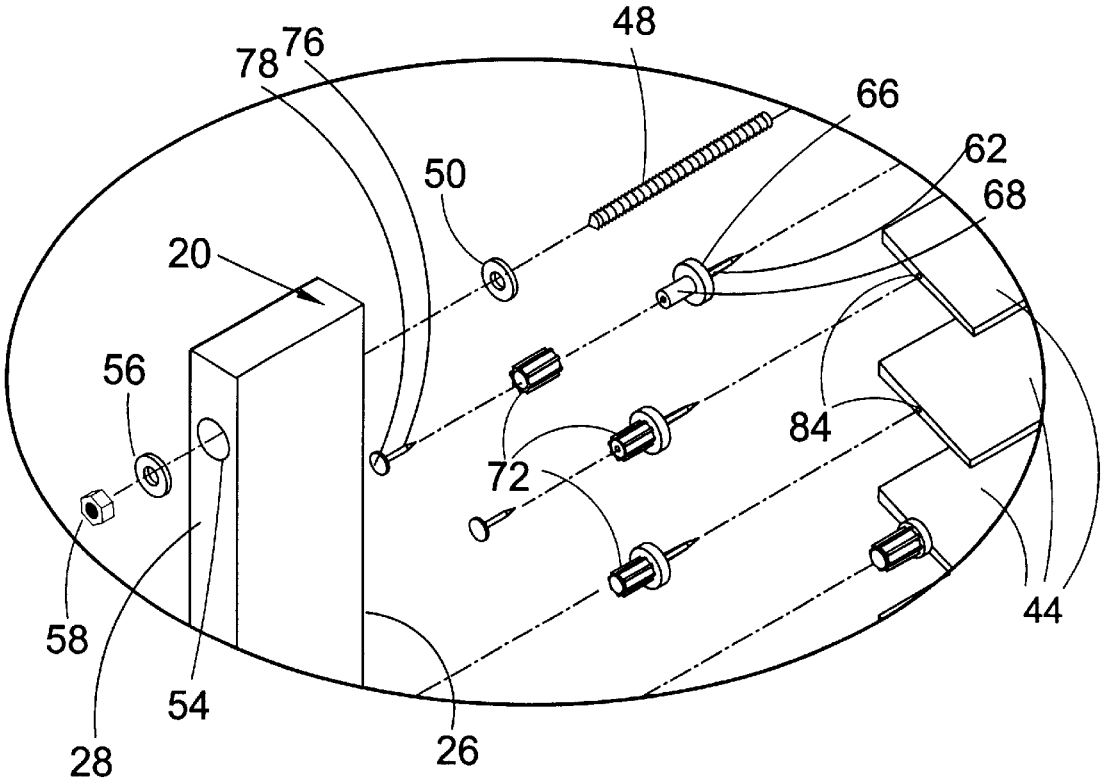
FIG. 4 is a detailed view of the connection members of the present invention. Shown are the louver to stile connection members in various stages of assembly.

FIGS. 3–4 and FIG. 9 depict the special attachment of the top and bottom louvers 40,42 to the stiles 20,30. The top and bottom louvers have threaded holes 46 for threadably receiving a hanger bolt 48. In A spacer 50 is placed on the bolt 48 prior to its insertion into a stile hole 52 bored from the stile inner edge 26 to the stile outer edge 28. The stile hole 52 is enlarged to form a recess 54 in the stile outer edge 28, the recess 54 being sized to receive a washer 56 and a retaining locknut 58.

The retaining locknut 58 causes the top and bottom louvers 40,42 to be fixedly attached to the stiles 20,30. When the nuts 58 are threadably attached to the hanger bolt 48, the stiles 20,30, top louver 40 and bottom louver 42 form a full rectangular frame, eliminating the need for a conventional top rail and bottom rail. The stile holes 52 are sized to allow rotation of the inserted hanger bolts 48, while the threaded holes 46 in the louvers 40,42 allow no rotation. This allows the top and bottom louvers 40,42 to move in concert with the inner louvers 44 when moved by the tilt rod 47.

Figure 5:
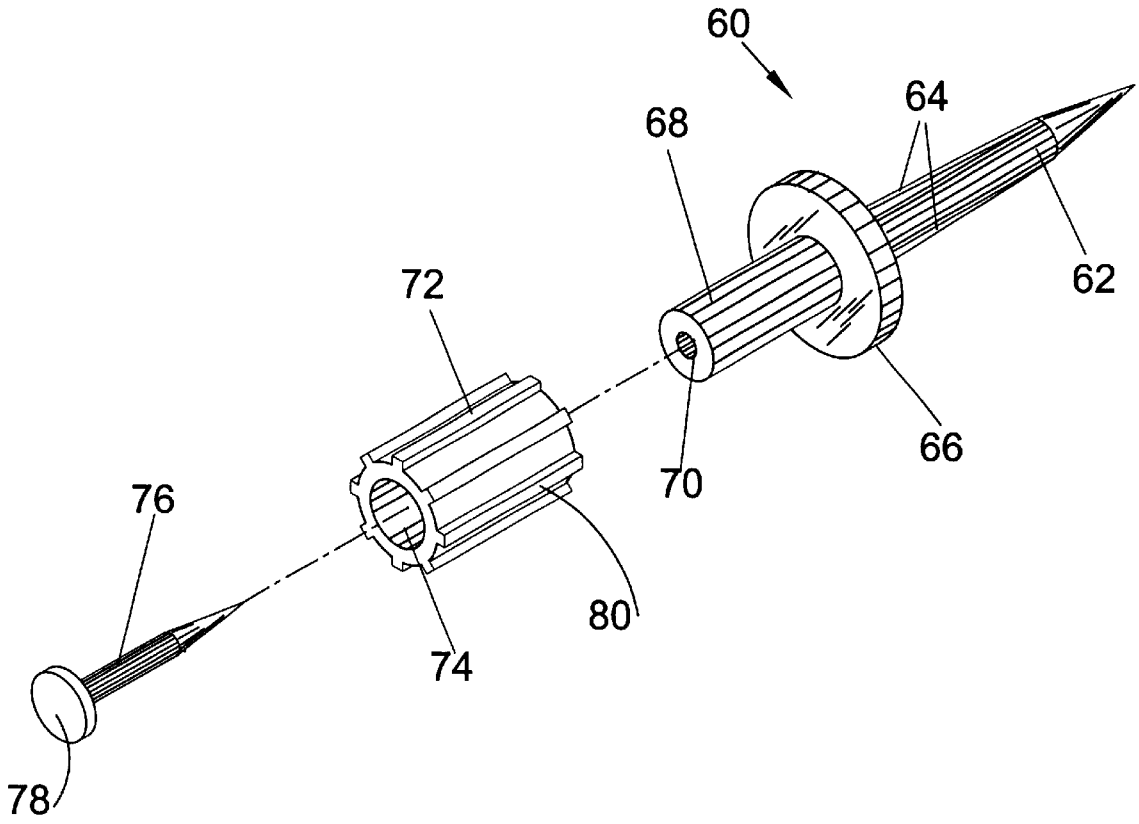
FIG. 5 is an exploded perspective view of the louver pin assembly.
Figure 6:
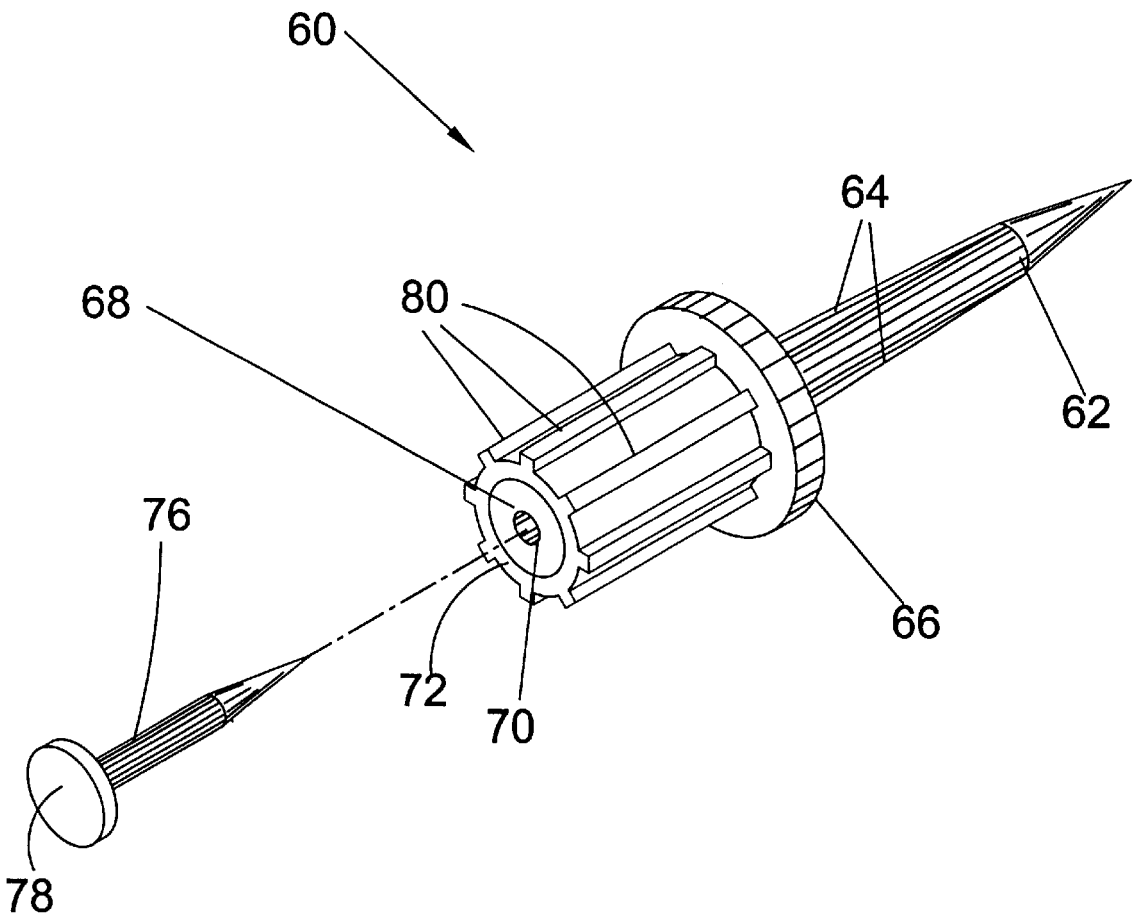
FIG. 6 is an exploded perspective view of the partially assembled louver pin assembly. The bushing has been placed over the expandable louver bushing post.
Figure 7:
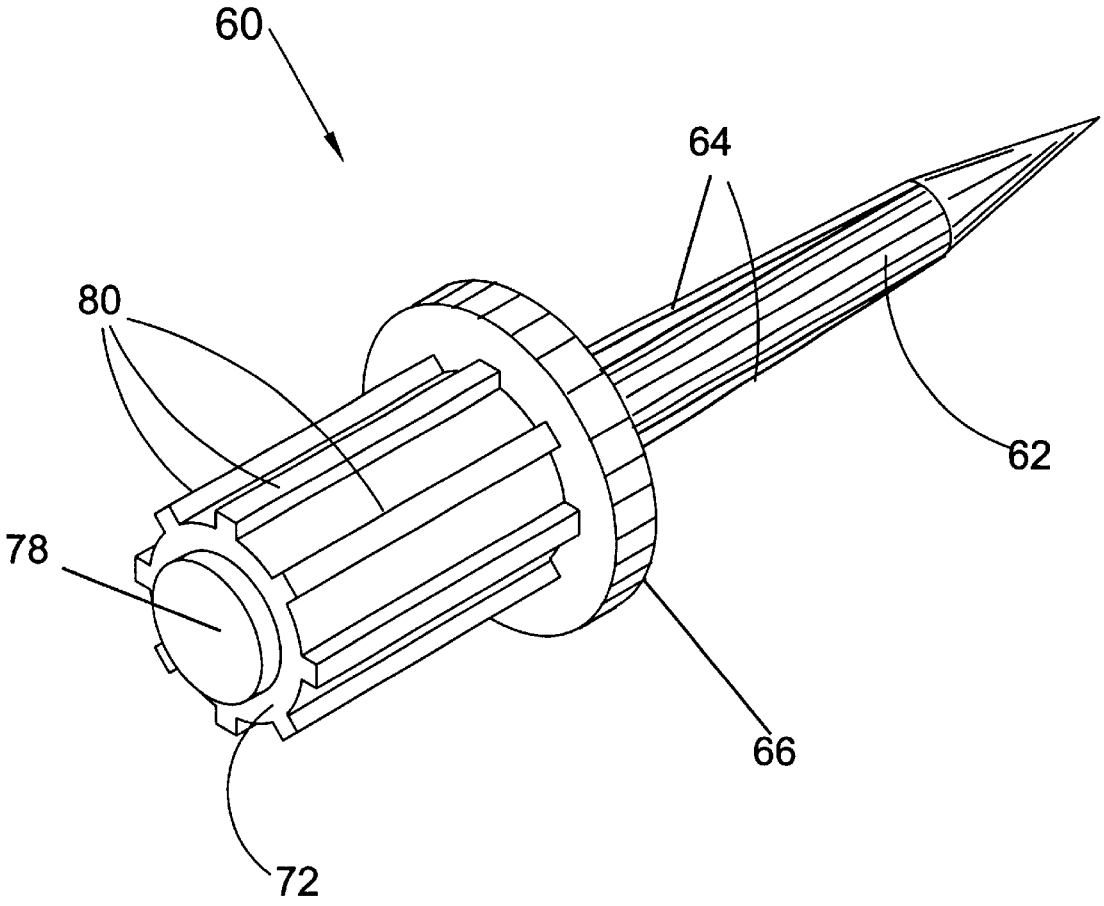
FIG. 7 is a perspective view of the assembled louver pin assembly.
Figure 8:
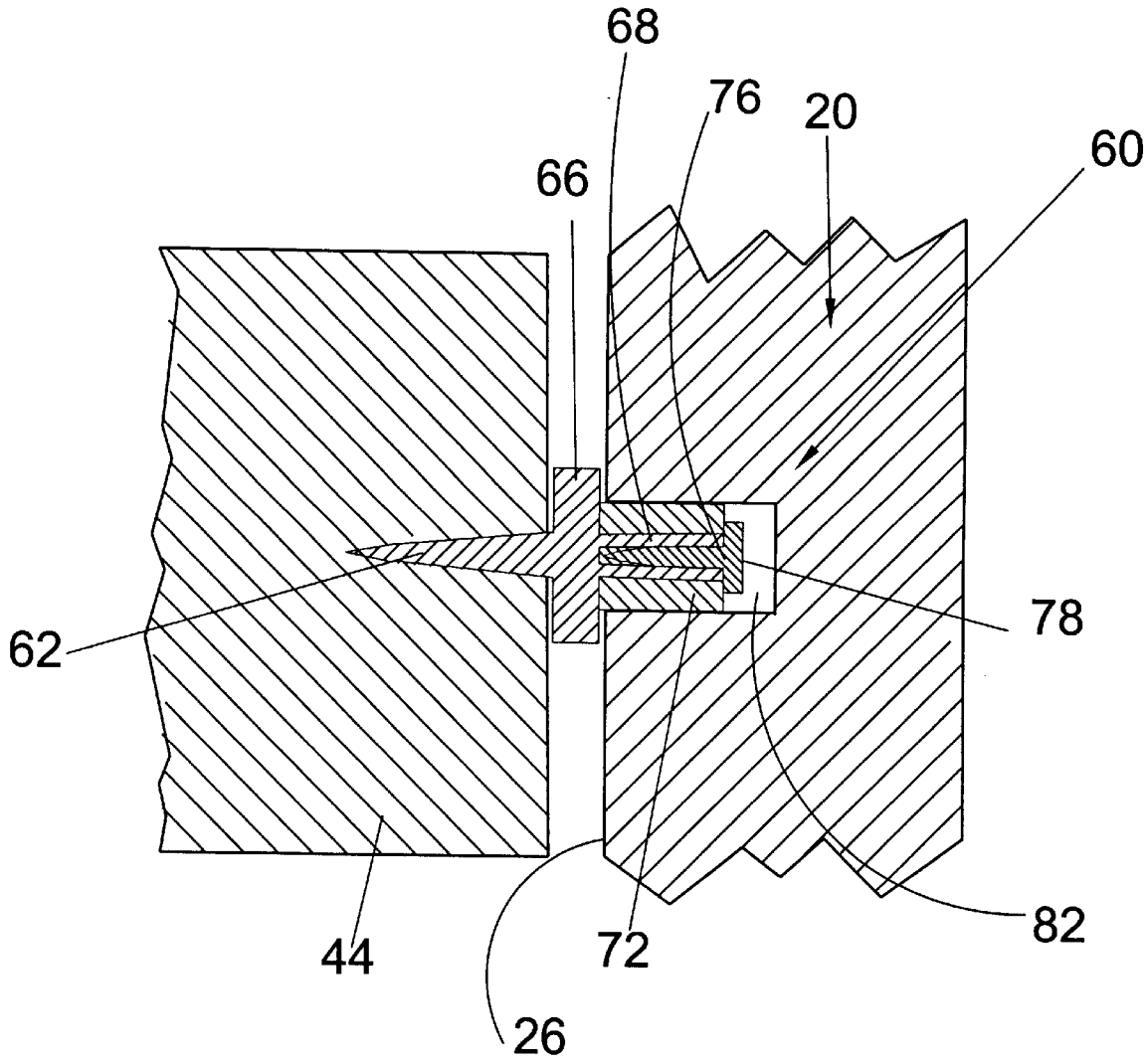
FIG. 8 is a sectional view of louver pin assembly connection between an inner louver and a stile. Shown is the louver tension fastener within the louver bushing preventing the louver tension fastener from rotating within the louver bushing, unless a force is applied through the tilt rod.

The inner louvers 44 are secured to the stile inner edges 26,36. As shown in FIGS. 3–4 and FIG. 8, louver pin assemblies 60 are positioned between each inner louver 44 and such edges 26,36. FIGS. 5–7 depict the incremental construction of such assemblies 60. A louver insertion nail 62, having anti-spin flanges 64 extending along the longitudinal length of the nail 62, extends from a spacing flange 66. Extending from the other side of the flange 66 is an expandable bushing post 68 having a recess 70.

A bushing 72 having a hollow center 74 is placed about the bushing post 68 and then a tension pin 76 is driven into the bushing post recess 70. The tension pin 76 has a head 78 that is sized to prevent the bushing 72 from working loose from the expandable bushing post 68.

As the tension pin 76 is hammered into the recess 70, the expandable bushing post 68 expands against the bushing 72 causing bushing fins 80 to create an ever-increasing tightness of the bushing 72 within a stile inner edge recess 82 in the stile inner edges 26,36, as depicted in FIG. 8. This tightness allows the louvers 44 to maintain an upright position after being opened by the tilt rod 47. However, the tightness is insufficient to provide structural stability of the assembly 10 without the top louver 20 and bottom louver 30 fixed attachments to the stiles 20,30.

A louver starter hole 84 can be provided for the insertion nail 62, as shown in FIG. 4.

As shown in FIG. 1, the assembly 10 is readily positionable within a wall frame 12, and is uniquely useful in such frames 12 that are not substantially square, since the assembly 10 has no top and bottom rails to prevent a degree of parallel movement of the stiles 20,30 to adjust to the off-square frame 12 corners. Accommodating flexibility is provided by the bushing fins 80 and the general adjustability of the bushing 68 using the tension pins 76. For example, a slight angle of the bushing 68 in the tile inner edge holes 26,36 will provide some rotational fixability or maintaining that the rotational fix ability if the bushing 68 is diminished in width to allow parallel movements of the stiles 20,30.

The corresponding movement of the top and bottom louvers 40,42 with the inner louvers 44, and the absence of a top and lower rail, causing the current assembly 10 to provide more air and light entry (through the top and bottom) than a shutter assembly having lower and upper rails on stiles of the same length as the stiles 20,30 of the present assembly 10. This provides an increased air and light entry cross-sectional area approximately equal to two full louver widths, if the conventional lower and upper rails are of approximately the same width as the louvers 40,42,44. If such rails are even larger than the louvers 40,42,44 then the increase in light and air entry is even greater.

FIG. 10 depicts an embodiment 100 wherein two assemblies 100 have roller assemblies 102 attached to the stile upper portion 32 that ride in tracks 104 in the wall frame 106, such that the assemblies 100 are slidable with respect to each other. The stile lower portion 34 is positioned in slot tracks 108 to prevent swinging.

In another embodiment, only one of the conventional top or bottom rails is replaced by a special louver. When either is replaced the open end can be reversibly positioned at the top or bottom.

In another embodiment, a tilt mechanism includes an interconnected assembly of members attached to the louvers, the tilt mechanism having a rotating handle in geared communication with the interconnected assembly members such that rotation of the handle causes the louvers to rotate between open and closed positions. This tilt mechanism uses conventional shutter assembly opening and closing mechanisms that are readily adaptable to the present invention.

In another embodiment, an additional attaching louver can be added centrally between the upper and lower attaching louvers, or between a single attaching louver and a conventional rail. In a particularly long shutter assembly, this addition provides additional fixed attachment in the mid-section to avoid bowing.

The above embodiments 10,100 can include stiles and louvers constructed from conventional materials, such as wood, metal glass, and various plastics.

With respect to the above description then, it is to be realized that the optimum material and dimensional relationships for the parts of the shutter assembly 10, will include variations in size, materials, shape, and form, which will occur to those skilled in the art upon review of the present disclosure. All equivalent relationships to those illustrated in the drawings and described in the specification are intended to be encompassed by the present invention.

What is claimed as new and desired to be protected by Letters Patent is set forth in the appended claims:

1. A shutter assembly, comprising:

a pair of opposite side, elongated and generally parallel upright stiles, each having first portion and a second portion;

rails fixedly attaching the stile second portions;

a plurality of louvers spaced between and along the length of the stiles, the louvers having a longitudinal axis, each louver being secured between the stiles for rotation about said louver's longitudinal axis, only one of the louvers being a first portion attaching louver, the attaching louver fixedly attaching the stile first portions, such that said attaching louver, the stiles and the rail form a frame;

a tilting mechanism for simultaneously rotating all the louvers between open and closed positions;

the first portion attaching louver has a first end and a second end, each end having a hole;

the stile first portions each have a hole, the holes being generally aligned with the attaching louver longitudinal axis; and the assembly further comprises two elongated members, each member being inserted through one of the stile first portion holes, the inserted end then being inserted into one of the attaching louver end holes, the members being adapted such that the members rotate in the stile first portion holes and are fixed for non-rotation in the attaching louver end holes; and the assembly further comprises a pair of nuts, the elongated members have threaded ends, and the attaching louver end holes are threaded for receiving one of the elongated member's threaded ends, the nuts being threadably attached to other elongated member's end.

2. The assembly of claim 1, wherein the tilt mechanism is a tilt rod attached to each of the louvers.

3. The assembly of claim 1, wherein the tilt mechanism is an interconnected assembly of members attached to the louvers, the tilt mechanism further having a handle for rotation, the interconnected assembly being responsive to the handle rotation such that the louvers are rotated.

4. The assembly of claim 1, wherein the first portion attaching louver is the uppermost of the plurality of louvers.

5. The assembly of claim 1, wherein the first portion attaching louver is the lowermost of the plurality of louvers.

6. The assembly of claim 1, wherein the stile first portion holes each have an enlargement, the enlargements each being adapted to allow one of the nuts to recess completely within the hole enlargement.

7. The assembly of claim 1, wherein the assembly further comprises a pair of spacers and the attaching louver has a first and second end, one of the spacers being positioned between the attaching louver first end and one of the stiles, the other spacer positioned between the attaching louver second end and the other of the stiles.

8. The assembly of claim 1, wherein the assembly has upwardly extending rollers and is fitted in a frame having a track for suspending the rollers, allowing rolling movement of the assembly within the frame.

9. A shutter assembly, comprising:

a pair of opposite side, elongated and generally parallel upright stiles, each having an upper portion and a lower portion;

a plurality of louvers spaced between and along the length of the stiles, the louvers having a longitudinal axis, each louver being secured between the stiles for rotation about said louver's longitudinal axis, only one of the louvers being an upper attaching louver, and only one of the other louvers being a lower attaching louver, the upper attaching louver fixedly attaching the stile upper portions, the lower attaching louver fixedly attaching the stile lower portions, such that said attaching louvers and the stiles form a frame; and a tilting mechanism for simultaneously rotating all the louvers between open and closed positions;

the attaching louvers each having a first end and a second end, each end having a hole;

the stile upper portions and lower portions each have a hole, each of the holes being generally aligned with one of the attaching louvers' longitudinal axes; and the assembly further comprises four elongated members, each member being inserted through one of the stile upper portion or lower portion holes, the inserted end then being inserted into one of the attaching louvers' end holes, the members being adapted such that the members rotate in the stile upper portion and lower portion holes and are fixed for non-rotation in the attaching louvers' end holes;

the assembly further comprises two pair of nuts, the elongated members have threaded ends, and the attaching louvers' end holes are threaded for receiving one of the elongated member's threaded ends, the nuts being threadably attached to other elongated member's end.

10. The assembly of claim 6, wherein the stiles have a inner portion and only one of the plurality of louvers is an inner attaching louver, the inner attaching louver fixedly attaching the stile inner portions.

11. The assembly of claim 9, wherein the tilt mechanism is a tilt rod attached to each of the louvers.

12. The assembly of claim 9, wherein the tilt mechanism is an interconnected assembly of members attached to the louvers, the tilt mechanism further having a handle for rotation, the interconnected assembly being responsive to the handle rotation such that the louvers are rotated.

13. The assembly of claim 9, wherein the upper attaching louver is the uppermost of the plurality of louvers, and the lower attaching louver is the lowermost of the plurality of louvers.

14. The assembly of claim 9, wherein the stile upper and lower portion holes each have an enlargement, the enlargements each being adapted to allow one of the nuts to recess completely within the hole enlargement.

15. The assembly of claim 9, wherein the assembly further comprises a pair of stile recesses aligned with each non-attaching louver, and a pair of louver pin assemblies for securing each of the non-attaching louvers to the stiles, each of the louver pin assemblies having:

a spacer flange, a louver insertion nail, and an expandable bushing post, the insertion nail extending from the spacer flange and the bushing post extending from the spacer flange in the opposite direction from the insertion nail, the insertion nail having anti-slip flanges running longitudinally along the nail, the bushing post having a recess, the insertion nail being driven into the non-attaching louver end, the anti-slip flanges preventing rotation of the nail in said louver, a bushing having flexible exterior fins and a recess, the recess being sized to receive the bushing post; and a tension nail for driving into the bushing post recess causing the bushing post to expand against the bushing, said expansion causing the bushing to expand and the bushing fins to increasingly bear upon the stile recess interior when the bushing is in the stile recess, such that the bushing can rotate in response to the tilt mechanism motion, but will maintain position when the tilt mechanism motion ceases.

16. The assembly of claim 9, wherein the attaching louvers each have a pair of louver threaded holes, the stiles each have a pair of stile holes with enlarged exterior portions, each of the stile holes being aligned with one of the attaching louver threaded holes, and the assembly further comprises a pair of louver securement assemblies for fixedly attaching each of the attaching louvers to the stiles, each of the louver securement assemblies having:

an elongated member having two threaded ends, one end for threading into one of the attaching louver threaded holes;

a spacer for positioning on the elongated member between the attaching louver and the stile;

a nut for threadably attaching to the other threaded end after insertion through the stile hole, the tightened nut resting at least partially in the stile hole enlarged portion, the tightened nut fixedly attaching the stile to the louver, such that the elongated member rotates in the stile hole, but not in the threaded louver hole, the rotation being in response to motion of the tilt mechanism.

17. The assembly of claim 9, wherein the assembly further comprises two pairs of spacers and the upper attaching louver has a first and second end, and the lower attaching louver has a first and second end, one of the spacers in the first pair being positioned between the upper attaching louver first end and one of the stiles, the other spacer in the first pair being positioned between the attaching louver second end and the other of the stiles, and one of the spacers in the second pair being positioned between the lower attaching louver first end and one of the stiles, the other spacer in the second pair being positioned between the other of the stiles.

18. The assembly of claim 9, wherein the assembly has upwardly extending rollers and is fitted in a frame having a track for suspending the rollers, allowing rolling movement of the assembly within the frame.

19. A shutter assembly, comprising:

a pair of opposite side, elongated and generally parallel upright stiles, each having an upper portion and a lower portion;

a plurality of louvers spaced between and along the length of the stiles, the louvers having a longitudinal axis, each louver being secured between the stiles for rotation about said louver's longitudinal axis, the uppermost of the louvers being an upper attaching louver, and the lowermost of the other louvers being a lower attaching louver, the upper attaching louver fixedly attaching the stile upper portions, the lower attaching louver fixedly attaching the stile lower portions, such that said attaching louvers and the stiles form a frame;

a tilting mechanism for simultaneously rotating all the louvers between open and closed positions, the tilt mechanism being a tilt rod attached to each of the louvers, and further wherein:

the attaching louvers each have a pair of louver threaded holes, the stiles each have a pair of stile holes with, enlarged exterior portions, each of the stile holes being aligned with one of the attaching louver threaded holes, and the assembly further comprises a pair of louver securement assemblies for fixedly attaching each of the attaching louvers to the stiles, each of the louver securement assemblies having:

an elongated member having two threaded ends, one end for threading into one of the attaching louver threaded holes;

a spacer for positioning on the elongated member between the attaching louver and the stile;

a nut for threadably attaching to the other threaded end after insertion through the stile hole, the tightened nut resting at least partially in the stile hole enlarged portion, the tightened nut fixedly attaching the stile to the louver, such that the elongated member rotates in the stile hole, but not in the threaded louver hole, the rotation being in response to motion of the tilt mechanism;

the assembly further comprises a pair of stile recesses aligned with each non-attaching louver, and a pair of louver pin assemblies for securing each of the non-attaching louvers to the stiles, each of the louver pin assemblies having:

a spacer flange, a louver insertion nail, and an expandable bushing post, the insertion nail extending from the spacer flange and the bushing post extending from the spacer flange in the opposite direction from the insertion nail, the insertion nail having anti-slip flanges running longitudinally along the nail, the bushing post having a recess, the insertion nail being driven into the non-attaching louver end, the anti-slip flanges preventing rotation of the nail in said louver;

a bushing having flexible exterior fins and a recess, the recess being sized to receive the bushing post;

a tension nail for driving into the bushing post recess causing the bushing post to expand against the bushing, said expansion causing the bushing to expand and the bushing fins to increasingly bear upon the stile recess interior when the bushing is in the stile recess, such that the bushing can rotate in response to the tilt mechanism motion, but will maintain position when the tilt mechanism motion ceases; and the assembly further comprises two pairs of spacers and the upper attaching louver has a first and second end, and the lower attaching louver has a first and second end, one of the spacers in the first pair being positioned between the upper attaching louver first end and one of the stiles, the other spacer in the first pair being positioned between the attaching louver second end and the other of the stiles, and one of the spacers in the second pair being positioned between the lower attaching louver first end and one of the stiles, the other spacer in the second pair being positioned between the other of the stiles.

20. A shutter assembly, comprising:

a pair of opposite side, elongated and generally parallel upright stiles, each having first portion and a second portion;

rails fixedly attaching the stile second portions;

a plurality of louvers spaced between and along the length of the stiles, the louvers having a longitudinal axis, each louver being secured between the stiles for rotation about said louver's longitudinal axis, only one of the louvers being a first portion attaching louver, the attaching louver fixedly attaching the stile first portions, such that said attaching louver, the stiles and the rail form a frame; and a tilting mechanism for simultaneously rotating all the louvers between open and closed positions;

the assembly further comprises a pair of stile recesses aligned with each non-attaching louver, and a pair of louver pin assemblies for securing each of the non-attaching louvers to the stiles, each of the louver pin assemblies having:

a spacer flange, a louver insertion nail, and an expandable bushing post, the insertion nail extending from the spacer flange and the bushing post extending from the spacer flange in the opposite direction from the insertion nail, the insertion nail having anti-slip flanges running longitudinally along the nail, the bushing post having a recess, the insertion nail being driven into the non-attaching louver end, the anti-slip flanges preventing rotation of the nail in said louver;

a bushing having flexible exterior fins and a recess, the recess being sized to receive the bushing post; and a tension nail for driving into the bushing post recess causing the bushing post to expand against the bushing, said expansion causing the bushing to expand and the bushing fins to increasingly bear upon the stile recess interior when the bushing is in the stile recess, such that the bushing can rotate in response to the tilt mechanism motion, but will maintain position when the tilt mechanism motion ceases.

21. A shutter assembly, comprising:

a pair of opposite side, elongated and generally parallel upright stiles, each having first portion and a second portion;

rails fixedly attaching the stile second portions;

a plurality of louvers spaced between and along the length of the stiles, the louvers having a longitudinal axis, each louver being secured between the stiles for rotation about said louver's longitudinal axis, only one of the louvers being a first portion attaching louver, the attaching louver fixedly attaching the stile first portions, such that said attaching louver, the stiles and the rail form a frame;

a tilting mechanism for simultaneously rotating all the louvers between open and closed positions;

the attaching louver has a pair of louver threaded holes, the stiles each have a pair of stile holes with enlarged exterior portions, each of the stile holes being aligned with one of the attaching louver threaded holes, and the assembly further comprises a pair of louver securement assemblies for fixedly attaching the attaching louver to the stiles, each of the louver securement assemblies having:

an elongated member having two threaded ends, one end for threading into one of the attaching louver threaded holes;

a spacer for positioning on the elongated member between the attaching louver and the stile;

a nut for threadably attaching to the other threaded end after insertion through the stile hole, the tightened nut resting at least partially in the stile hole enlarged portion, the tightened nut fixedly attaching the stile to the louver, such that the elongated member rotates in the stile hole, but not in the threaded louver hole, the rotation being in response to motion of the tilt mechanism.

* * * * *